US011506391B1

(12) United States Patent
Salinas Trejo et al.

(10) Patent No.: US 11,506,391 B1
(45) Date of Patent: Nov. 22, 2022

(54) CROSS-FIRE TUBE FOR GAS TURBINE WITH AXIALLY SPACED PURGE AIR HOLE PAIRS

(71) Applicant: General Electric Company, Schenectady, NY (US)

(72) Inventors: Jose Mauricio Salinas Trejo, Queretaro (MX); Paola Martinez Melloni, Queretaro (MX); Jose Manuel Mendoza Perez, Queretaro (MX)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/474,153

(22) Filed: Sep. 14, 2021

(51) Int. Cl.
*F23R 3/48* (2006.01)
*F23R 3/08* (2006.01)

(52) U.S. Cl.
CPC . *F23R 3/48* (2013.01); *F23R 3/08* (2013.01)

(58) Field of Classification Search
CPC ..... F23R 3/08; F23R 3/48
See application file for complete search history.

(56) References Cited

U.S. PATENT DOCUMENTS 3,811,274 A * 5/1974 Calderon ..... F23R 3/48 60/800
5,001,896 A * 3/1991 Hilt ..... F23R 3/48 60/39.821
5,896,742 A 4/1999 Black et al.
6,705,088 B2 3/2004 Martling et al.

FOREIGN PATENT DOCUMENTS

EP 866274 A2 * 9/1998 ..... F23R 3/48
EP 0972993 B1 9/2006

OTHER PUBLICATIONS

Basse, "Flow-Based Optimization of Products or Devices," Fluids, 5:56, 2020.
Rhee et al., "Experimental Study of Film Cooling Performance on Turbine Guide Vane with Optimized Hole Arrangements in a Transonic Annular Sector Cascade," 16th International Symposium on Transport Phenomena and Dynamics of Rotating Machinery, Apr. 2016, Honolulu, United States, hal.01894414.

* cited by examiner

*Primary Examiner* — Steven M Sutherland
(74) *Attorney, Agent, or Firm* — James Pemrick; Charlotte Wilson; Hoffman Warnick LLC

(57) ABSTRACT

A cross-fire tube for connecting adjacent combustors in a gas turbine, and a combustion section including the cross-fire tube, are disclosed. The cross-fire tube includes a hollow tubular body having opposite ends, and a plurality of purge air hole pairs is defined in the hollow tubular body and located at more than two different axial positions between the opposite ends. Purge air flows through the plurality of purge air hole pairs to create a uniform distribution of the purge air between the adjacent combustors. The velocity of the purge air exiting the ends of the cross-fire tube can be, for example, 25% higher. The cross-fire tube having the hole arrangements described herein also extends the life expectancy of the tube by reducing oxidation.

17 Claims, 6 Drawing Sheets

CROSS-FIRE TUBE FOR GAS TURBINE WITH AXIALLY SPACED PURGE AIR HOLE PAIRS

TECHNICAL FIELD

The disclosure relates generally to gas turbine combustion sections, and more particularly, to a cross-fire tube extending between adjacent combustors in a can annular combustion section of a gas turbine. The cross-fire tube includes axially spaced purge air hole pairs defined in the hollow tubular body and located at more than two different axial positions between the opposite ends of the tube.

BACKGROUND

Gas turbines may use combustors having a can annular arrangement in which, for example, 10, 14 or 18, combustors or cans are arranged in a circle about the axial centerline of the gas turbine. The combustors are isolated from one another, except for the cross-fire tube connections between adjacent cans. The cross-fire tubes provide for a crossing of a flame from one can to the next during ignition. Current gas turbines employ two cans with ignition devices (spark plugs), while the other cans are lighted by the flame passing through the cross-fire tubes from the adjoining lighted can. Further, the cross-fire tubes must also pass flame from the lighted to the unlighted premixing regions of the cans during transfer from a premixed mode to a lean-lean mode. In the premixed mode, the region of the combustor connected by cross-fire tubes has no flame and is used for premixing the fuel and air, while in the lean-lean mode this same region has flame. The specific function of the cross-fire tubes, whether during ignition or re-light of the premixing zone, is simply to pass flame from adjoining cans. This process generally occurs in a matter of seconds. At all other times in the gas turbine operation, the cross-fire tubes perform no specific function.

When the cross-fire tubes are not in use, they must resist the unwanted passage of either hot gases from combustion or unburned fuel in the premixing zone from adjoining cans. This continuous cross-flow is caused, for example: by chamber-to-chamber pressure differences resulting from small geometrical differences among the combustion hardware; from unequal distribution of fuel to the individual chambers; and from area variations in the gas turbine first stage nozzle passages. Continuous cross-flow of hot gas can permanently damage the combustion liner or cross-fire tube due to heating of the metal to its melting point. Some cooling is provided to the liner and cross-fire tubes to protect against this cross-flow, but it may not be sufficient for protection at high levels of cross-flow. Passage of unburned fuel from one can to the next produces a situation in the receiving can where the additional fuel produces streaks of fuel through the combustor. Hot streaks produced by the burning of this additional fuel may cause local over-heating of combustion components or a situation where, in the premixed mode, flame travels upstream with the fuel streak and produces a flashback event. A flashback event is a premature and unwanted re-light of the premixing zone during premixed mode operation, which produces an order of magnitude increase in NOx emissions due to the momentary transfer out of the premixed mode.

A similar challenge relative to emissions control is the requirement that fuel oil, when used, not be ingested into the cross-fire tubes. Ingestion of fuel oil can occur because the ends of the cross-fire tubes are located adjacent to the fuel nozzles to allow for ignition cross-firing. If fuel oil is ingested into the cross-fire tubes, it will remain there until either auto-igniting or burning by the cross-flow of hot gases. Burning of the fuel oil within the cross-fire tube can damage not only the cross-fire tube but also the liner.

In one approach to address these challenges, purge flow is admitted into the tube at two sets of four holes that are symmetrically arranged relative to a mid-section of the tube in an axial direction thereof. The four holes in each set are circumferentially equally spaced about the tube. Air jets produced by the purge flow entering the tube coalesce at the tube axial centerline, such that the purge air is directed in both longitudinal directions to prevent cross-flow. In another approach, the cross-fire tube includes a taper from the mid-section to the opposite ends of the tubes, and purge flow is introduced through circumferentially equally spaced holes at the tube mid-section. The taper accelerates the purge flow into the respective liners. Despite these advancements, the cross-fire tubes may still exhibit troubling high temperatures and ingestion of unwanted fuel or hot gases.

BRIEF DESCRIPTION

All aspects, examples, and features mentioned below can be combined in any technically possible way.

An aspect of the disclosure provides a cross-fire tube for connecting adjacent combustors in a gas turbine, the cross-fire tube comprising: a hollow tubular body having opposite ends; and a plurality of purge air hole pairs defined in the hollow tubular body and located at more than two different axial positions between the opposite ends, and wherein purge air flows through the plurality of purge air hole pairs to thereby provide, in use, uniform distribution of a purge air between the adjacent combustors.

Another aspect of the disclosure includes any of the preceding aspects, and the plurality of purge air hole pairs are unevenly spaced along a length of the hollow tubular body.

Another aspect of the disclosure includes any of the preceding aspects, and the hollow tubular body includes two sections joined at a mid-section, and wherein the plurality of purge air hole pairs is asymmetrically spaced relative to the mid-section along a length of the hollow tubular body.

Another aspect of the disclosure includes any of the preceding aspects, and the two sections include a male section and a female section, the male section telescopingly received within the female section at the mid-section.

Another aspect of the disclosure includes any of the preceding aspects, and two of the plurality of purge air hole pairs are provided in the male section, and two of the plurality of purge air hole pairs are provided in the female section.

Another aspect of the disclosure includes any of the preceding aspects, and each of the plurality of purge air hole pairs is circumferentially offset from one another.

Another aspect of the disclosure includes any of the preceding aspects, and the plurality of purge air hole pairs includes four purge air hole pairs.

Another aspect of the disclosure includes any of the preceding aspects, and the hollow tubular body has a substantially circular cross-sectional shape with a mid-section of the tube having one or more diameters, and wherein the hollow tubular body tapers continuously from the mid-section in opposite directions to the opposite ends which have diameters smaller than all of the one or more diameters in the mid-section such that when purge air flows through the plurality of purge air hole pairs, the purge air is accelerated as it flows toward the opposite ends.

Another aspect of the disclosure includes any of the preceding aspects, and the plurality of purge air hole pairs is unevenly spaced along a length of the hollow tubular body.

Another aspect of the disclosure includes any of the preceding aspects, and the plurality of purge air hole pairs is asymmetrically spaced relative to the mid-section along a length of the hollow tubular body.

Another aspect of the disclosure includes any of the preceding aspects, and the two sections include a male section and a female section, the male section telescopingly received within the female section at the mid-section.

Another aspect of the disclosure includes any of the preceding aspects, and two of the plurality of purge air hole pairs are provided in the male section, and two of the plurality of purge air hole pairs are provided in the female section.

Another aspect of the disclosure includes any of the preceding aspects, and each of the plurality of purge air hole pairs is circumferentially offset from one another.

Another aspect of the disclosure includes any of the preceding aspects, and the plurality of purge air hole pairs includes four purge air hole pairs.

An aspect of the disclosure relates to a combustion section for a gas turbine, comprising: a plurality of annularly arranged combustors; and a cross-fire tube fluidly coupling at least two adjacent combustors, the cross-fire tube including: a hollow tubular body having opposite ends; and a plurality of purge air hole pairs defined in the hollow tubular body and located at more than two different axial positions between the opposite ends, and wherein purge air flows through the plurality of purge air hole pairs to thereby provide, in use, uniform distribution of a purge air between the adjacent combustors.

Another aspect of the disclosure includes any of the preceding aspects, and the plurality of purge air hole pairs is unevenly spaced along a length of the hollow tubular body.

Another aspect of the disclosure includes any of the preceding aspects, and the hollow tubular body includes two sections joined at a mid-section, and wherein the plurality of purge air hole pairs is asymmetrically spaced relative to the mid-section along a length of the hollow tubular body.

Another aspect of the disclosure includes any of the preceding aspects, and each of the plurality of purge air hole pairs is circumferentially offset from one another.

Another aspect of the disclosure includes any of the preceding aspects, and the plurality of purge air hole pairs includes five purge air hole pairs.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
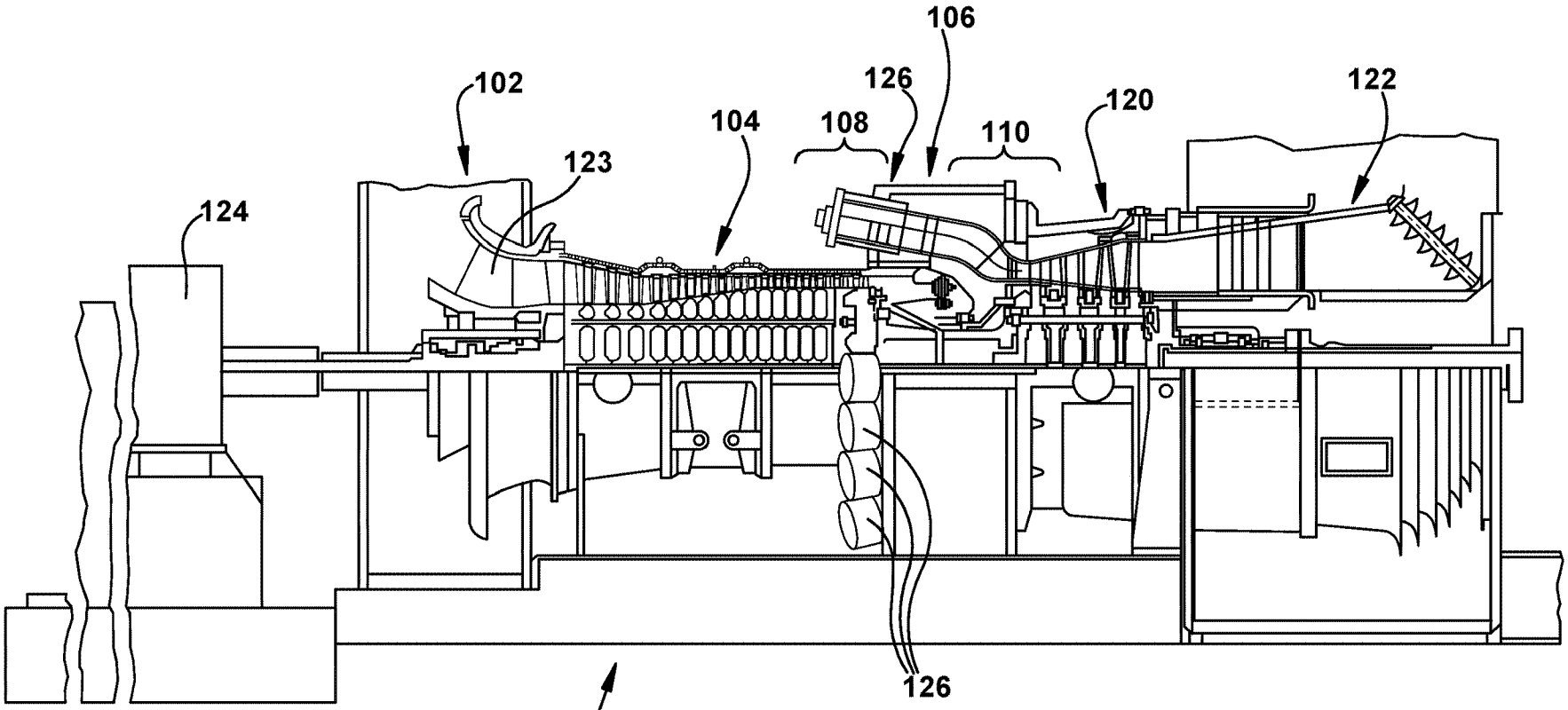
FIG. 1 shows a partial cross-sectional side view of a gas turbine (GT) system, according to an embodiment of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a gas turbine system or a combustor thereof. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the combustion gases in a combustor, the flow of air through the combustor, or coolant through one of the turbine's component systems. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the turbomachine.

It is often required to describe parts that are disposed at different radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

In addition, several descriptive terms may be used regularly herein, as described below. The terms "first," "second," and "third" may be used interchangeably to distinguish one component from another and are not intended to signify location or importance of the individual components.

The terminology used herein is for describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to," or "coupled to" another element or layer, it may be directly on, engaged to, connected to, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a cross-fire tube for connecting adjacent combustors in a gas turbine and a combustion section including the cross-fire tube. The cross-fire tube includes a hollow tubular body having opposite ends and a plurality of purge air hole pairs defined in the hollow tubular body and located at more than two different axial positions between the opposite ends. Purge air flows through the plurality of purge air hole pairs to create a uniform distribution of the purge air between the adjacent combustors. The purge air provides improved cooling and obstructs flow of hot combustion gas and unburned fuel. The velocity of the purge air exiting the ends of the cross-fire tube can be, for example, 25% higher than conventional systems. The cross-fire tube having the hole arrangements described herein also extends the life expectancy of the tube by reducing oxidation.

FIG. 1 shows a cross-sectional view of an illustrative gas turbine system application for a cross-fire tube and a combustion section, according to embodiments of the description. As will be recognized, a combustion section as described herein has a number of alternative applications, such as but not limited to: jet engines, blast furnaces, etc. In FIG. 1, gas turbine (GT) system 100 includes an intake section 102 and a compressor 104 downstream from intake section 102. Compressor 104 feeds air to a combustion section 106 that is coupled to a turbine section 120. Compressor 104 may include one or more stages of inlet guide vanes (IGVs) 123. As understood in the art, the angle of stages of IGVs 123 can be adjusted to control an air flow volume to combustion section 106 and thus parameters such as the combustion temperature of combustion section 106. Combustion section 106 includes a plurality of combustors 126. Each combustor 126 may include a primary combustion stage 108 including a first plurality of burners and may optionally include a secondary combustion stage 110 downstream from primary combustion stage 108. Secondary combustion stage 110 may include a second plurality of burners, different than the first plurality of burners.

Exhaust from turbine section 120 exits via an exhaust section 122. Turbine section 120 drives compressor 104 and a load 124 through a common shaft or rotor connection. Load 124 may be, for example, an electrical generator or other mechanical drive application, and may be located forward of intake section 102 (as shown) or aft of exhaust section 122. Examples of such mechanical drive applications include a compressor for use in oil fields and/or a compressor for use in refrigeration. Yet another load 124 may be a propeller as may be found in turbojet engines, turbofan engines, and turboprop engines.

Figure 2:
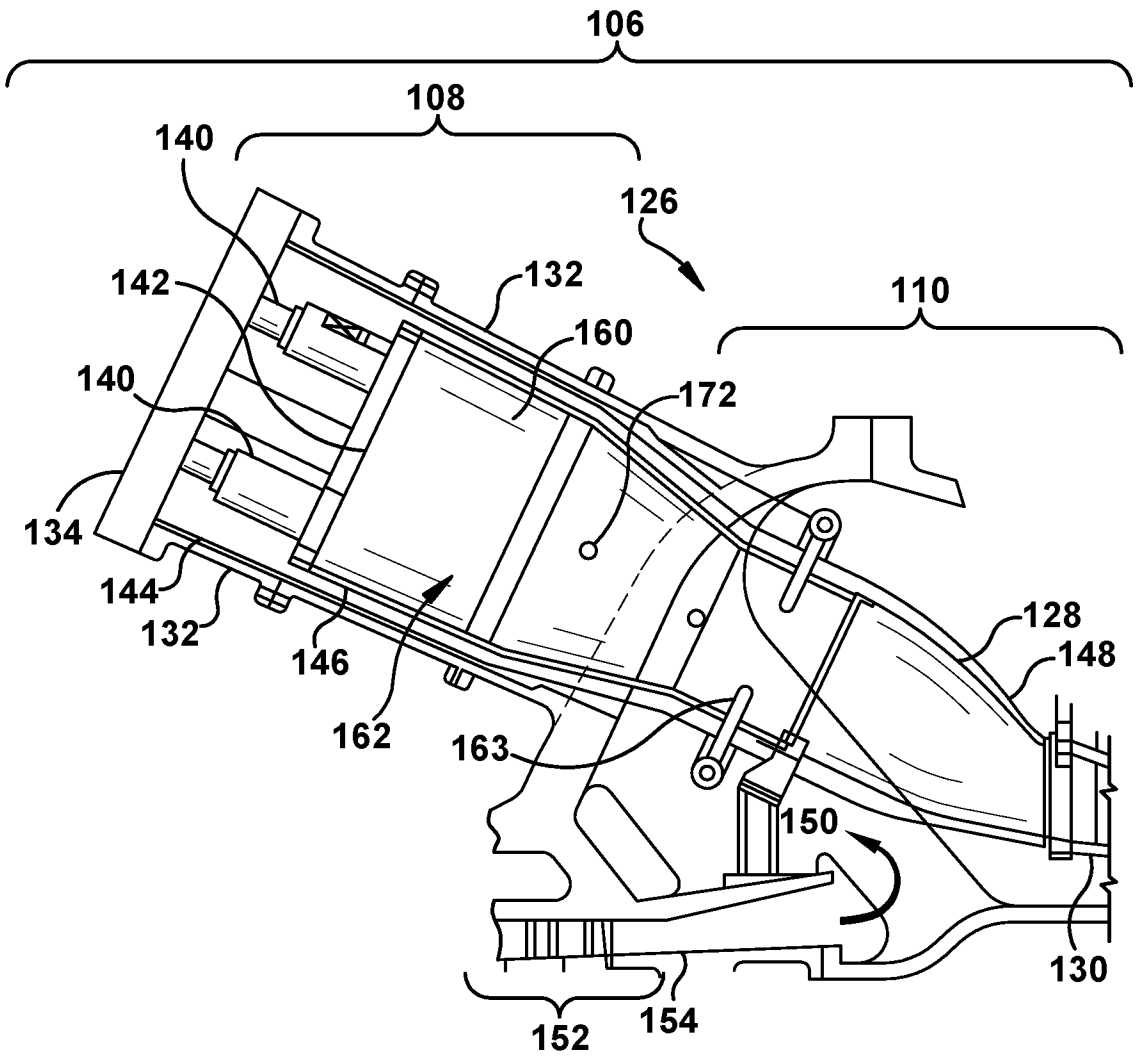
FIG. 2 shows a cross-sectional side view of a combustor for a combustion section useable in GT system of FIG. 1.

Referring to FIGS. 1 and 2, combustion section 106 may include a circular array of a plurality of circumferentially spaced combustors 126, also known as cans or combustion cans. FIG. 2 shows a cross-sectional side view of an illustrative combustor 126. A fuel/air mixture is burned in each combustor 126 to produce the hot energetic combustion gas flow, which flows through a transition piece 128 to turbine nozzles 130 of turbine section 120 (FIG. 1). For purposes of the present description, only one combustor 126 is illustrated, it being appreciated that all of the other combustors 126 arranged about the rotor within combustion section 106 are substantially identical to the illustrated combustor 126. FIG. 1 shows a plurality of circumferentially spaced combustors 126 that have come to be known in the art as can annular combustor systems, and FIG. 2 shows a cross-sectional side view of a combustor 126. It is contemplated that the present disclosure may be used in conjunction with other combustor systems.

Referring now to FIG. 2, an illustrative combustor 126 for GT system 100 (FIG. 1) including primary combustion stage 108 and an optional secondary combustion stage 110, is shown. It is emphasized that the teachings of the disclosure may be applied to a wide variety of other combustors 126, and the version described herein is for illustrative purposes only. A transition piece 128 directs hot combustion gas flow to turbine nozzles 130 and the turbine blades (not shown). Primary combustion stage 108 may include a casing 132, an end cover 134, a first plurality of burners 140, a cap assembly 142, a flow sleeve 144, and a combustion liner 146 within flow sleeve 144. An ignition device(s) (not shown) is/are provided in a number of combustors 126, e.g., two, and may include an electrically energized spark plug.

Combustion in primary combustion stage 108 occurs within combustion liner 146, which provides a combustion chamber 162. Combustion air is directed within combustion liner 146 via flow sleeve 144 and may enter combustion liner 146 through a plurality of openings formed in cap assembly 142. The air enters combustion liner 146 under a pressure differential and mixes with fuel from start-up burners (not shown) and/or first plurality of burners 140 within combustion liner 146. Consequently, a combustion reaction occurs within combustion liner 146 releasing heat to drive turbine section 120 (FIG. 2). The fuel and air initially combust in a primary reaction zone 160 of combustion chamber 162. High-pressure air for primary combustion stage 108 may enter flow sleeve 144 and a transition piece impingement sleeve 148, from an annular plenum 150. Compressor 104 (FIG. 1), which is represented by a series of vanes and blades at 152 and a diffuser 154 in FIG. 2, supplies high-pressure air for this purpose and other applications relative to burners 140.

As shown in FIG. 2, optional secondary combustion stage 110 includes a second plurality of burners 163 for transversely injecting a secondary fuel mixture into a combustion gas flow product of primary combustion stage 108. Burners 163 may include any variety and number of injection elements for injecting the second fuel mixture. Burners 163 may or may not extend radially into the combustion gas flow path. In one example, four circumferentially spaced burners 163 are employed. However, any number may be possible. It is also recognized that secondary combustion stage 110 may be omitted.

Figure 3:
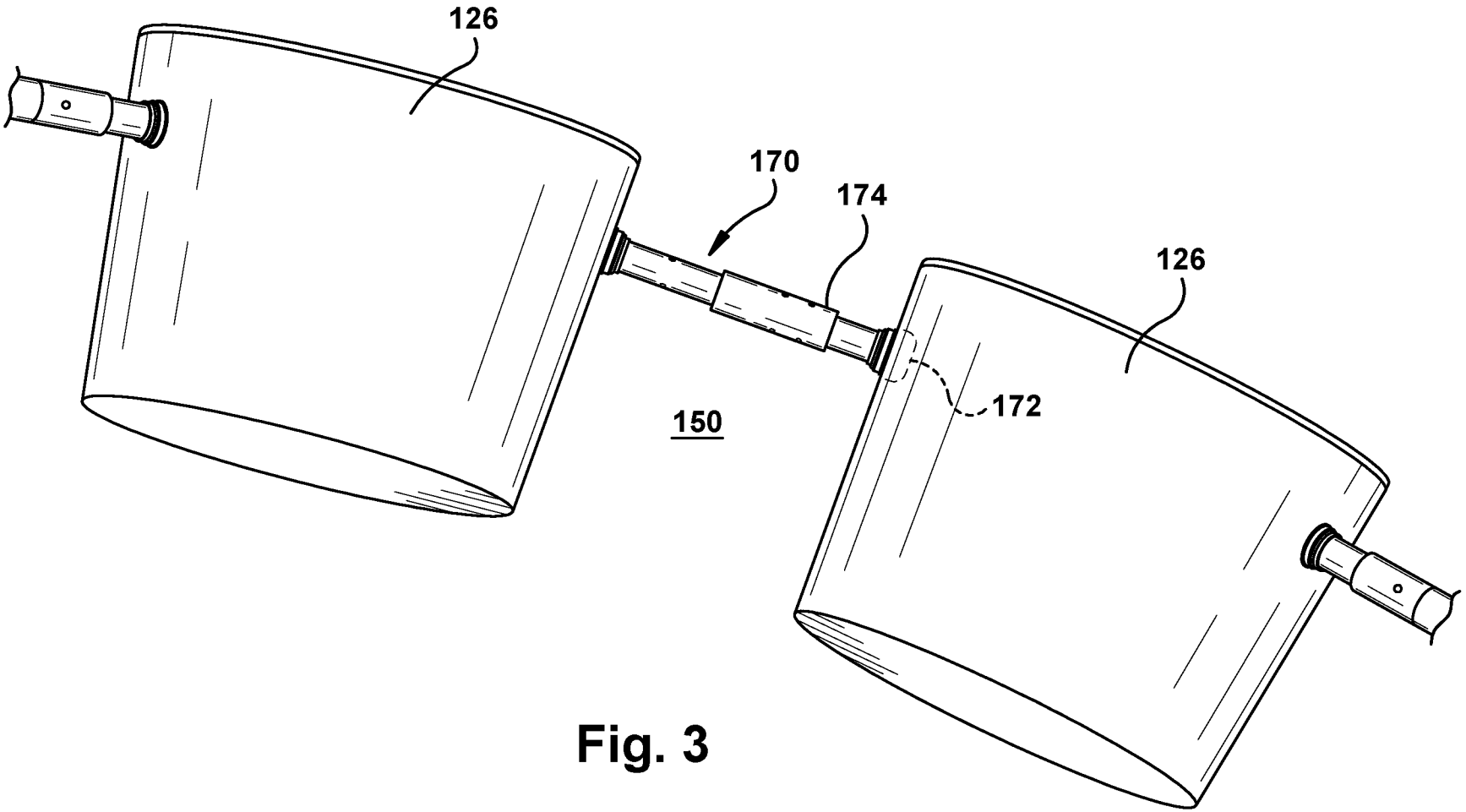
FIG. 3 shows a perspective view of a cross-fire tube between adjacent combustors, according to embodiments of the disclosure.

FIG. 3 shows a schematic, perspective view of a pair of adjacent combustors 126 having a cross-fire tube 170 connecting them together. While a single pair of adjacent combustors 126 are illustrated, it will be recognized that cross-fire tube 170 may connect each adjacent pair of combustors 126 in combustion section 106 (FIG. 1) of GT system 100 (FIG. 1). Cross-fire tube 170 is in fluid communication with combustion chamber 162 of adjacent combustors 126 by openings 172 (FIGS. 2 and 3) through, for example, flow sleeve 144 and combustion liner 146. An outer surface 174 of cross-fire tube 170 is in fluid communication with annular plenum 150, which supplies high-pressure air for cross-fire tube 170. As noted, compressor 104 (FIG. 1) supplies high-pressure air for this purpose and other applications.

Figure 4:
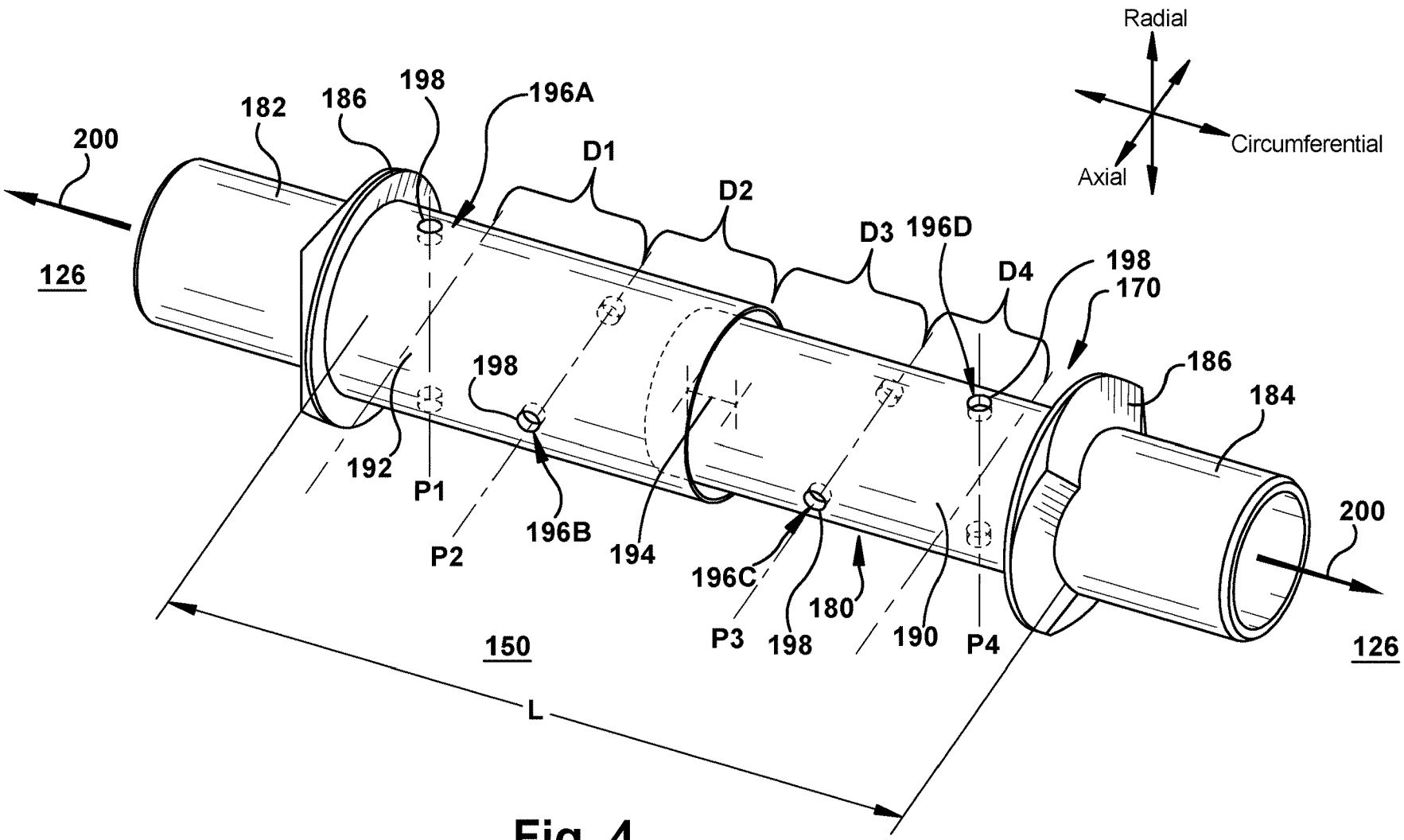
FIG. 4 shows a perspective view of a cross-fire tube, according to embodiments of the disclosure.

FIG. 4 shows an enlarged perspective view of a cross-fire tube 170 according to embodiments of the disclosure. Cross-fire tube 170 includes a hollow tubular body 180 having opposite ends 182, 184. Hollow tubular body 180 may have any cross-sectional shape, e.g., circular, oblong, etc. Opposite ends 182, 184 are configured to mate with adjacent combustors 126, e.g., by extending through flow sleeve 144 and combustion liner 146. Any form of connector such as a flange 186, welding, fasteners, etc., may be used.

Hollow tubular body 180 can take any variety of forms, allowing for assembly. In one embodiment, hollow tubular body 180 includes two sections 190, 192 joined at a mid-section 194. In the example shown, two sections 190, 192 include a male section 190 and a female section 192. Male section 190 may be telescopingly received within female section 192 at mid-section 194. In other embodiments, not shown, hollow tubular body 180 may include two female sections with a mating male section therebetween. It can also be one tubular body.

Cross-fire tube 170 includes a plurality of purge air hole pairs 196 defined in hollow tubular body 180 and located at more than two different axial positions (P1-Pn) between opposite ends 182, 184. Purge air holes 198 may be formed in cross-fire tube 170 in any manner, e.g., drilling. It has been determined that the placement of sets of four holes in a symmetric manner about mid-section 194 of the cross-fire tube does not necessarily provide desired resistance to cross-flow or desired cooling of cross-fire tube 170. With this pattern of purge air flow, some hot gases or unburned fuel may still bypass the air purge jets along the tube wall through the regions out of line with the air jets themselves. Thus, a flow condition can exist in which, even though purging flow exits both ends of the tube, there is a continuous flow of gases from one chamber to the next, depending on chamber-to-chamber pressure differences.

In the example shown in FIG. 4, cross-fire tube 170 includes four (4) purge air hole pairs 196A-D at four axial positions P1-P4. In use, purge air 200 flows through plurality of purge air hole pairs 196 to uniformly distribute a purge air between adjacent combustors 126. The purge air obstructs flow of hot combustion gas and unburned fuel through cross-fire tube 170. The plurality of purge air hole pairs 196 also improves cooling. The positioning of purge air hole pairs 196 at greater than two axial locations (P1-Pn) provides a better pattern of purge air flow that prevents hot gases or unburned fuel from bypassing the air purge jets. In addition, a velocity of purge air 200 flow can be increased, so temperatures can be reduced. For example, temperatures may be reduced by 6% on female section 192, and by 9% on male section 190.

Figure 5:
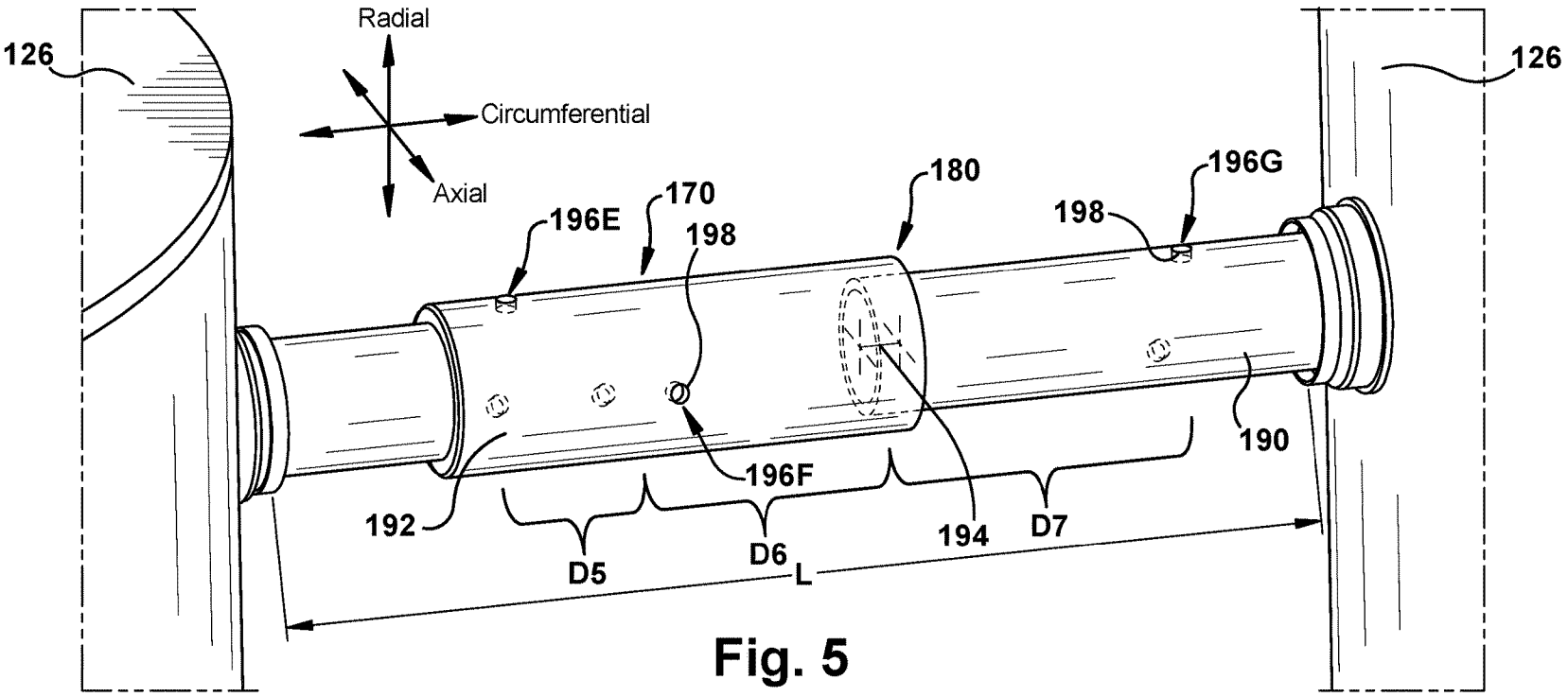
FIG. 5 shows a perspective view of a cross-fire tube between adjacent combustors, according to other embodiments of the disclosure.

In one embodiment, as shown in FIG. 4, purge air holes 198 are disposed in pairs 196 that may be circumferentially equally spaced on hollow tubular body 180, i.e., so holes 198 are diametrically opposite one another along a common axial position (e.g., P1-Pn). In another embodiment, as shown in the perspective view of FIG. 5, purge air holes 198 are arranged in pairs 196 that may be circumferentially unequally spaced on the tube, i.e., so holes 198 are not diametrically opposite one another. In FIG. 4, two of the plurality of purge air hole pairs 196C-D are provided in male section 190, and two of the plurality of purge air hole pairs 196A-B are provided in female section 192. FIG. 5 also shows an embodiment in which only three purge air hole pairs 196E-G are used.

In accordance with other embodiments, plurality of purge air hole pairs 196 may also be asymmetrically spaced relative to mid-section 194 along a length L of hollow tubular body 180. In this regard, mid-section 194 may be defined, for example, as a midpoint of cross-tube 170 length L, or as a midpoint of an overlap of male section 190 and female section 192. FIG. 4 shows distances D1-D4 between purge air hole pairs 196A-D or between purge air hole pairs 196A-D and the midpoint. In certain embodiments, plurality of purge air hole pairs 196 are unevenly spaced along length L of hollow tubular body 180. For example, distances D1-D4 may be all different, i.e., D1≠D2≠D3≠D4. A similar arrangement of distances D5-D7 is shown in FIG. 5. In other cases, not all the distances are different, i.e., some of distances D1-D4 may be the same even though the circumferential spacing is uneven.

Figure 6:
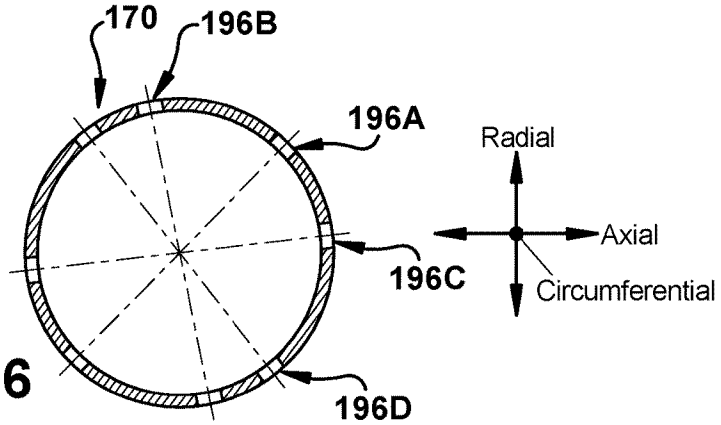
FIG. 6 shows a schematic cross-sectional view of a cross-fire tube, according to another embodiment of the disclosure.

With reference to FIG. 4, in certain embodiments, each of the plurality of purge air hole pairs 196 may be circumferentially aligned relative to other pairs. For example, in FIG. 4, purge air hole pairs 196A, 196D may be circumferentially aligned such that holes 198 thereof are both vertically arranged, i.e., so their holes open vertically up and vertically down. Similarly, in FIG. 4, purge air hole pairs 196B, 196C may be circumferentially aligned such that holes 198 thereof are both horizontally arranged, i.e., so their holes open horizontally in opposite directions. With reference to FIGS. 5 and 6, in certain embodiments, each of the plurality of purge air hole pairs 196 may be circumferentially offset from one another by an angle other than 180 degrees. That is, purge air hole pairs 196A-D may be circumferentially rotated relative to one another such that holes 198 do not all face the same direction into tube 170. For example, a few of holes 198 or none of holes 198 may face in the same direction.

Regardless of embodiment, holes 198 are arranged in pairs 196 to provide customized and optimized purge air 200 flow for the particular cross-fire tube 170 and combustors 126. Ideal positioning can be identified, for example, using computational fluid dynamic (CFD) modeling or other forms of modeling.

Figure 7:
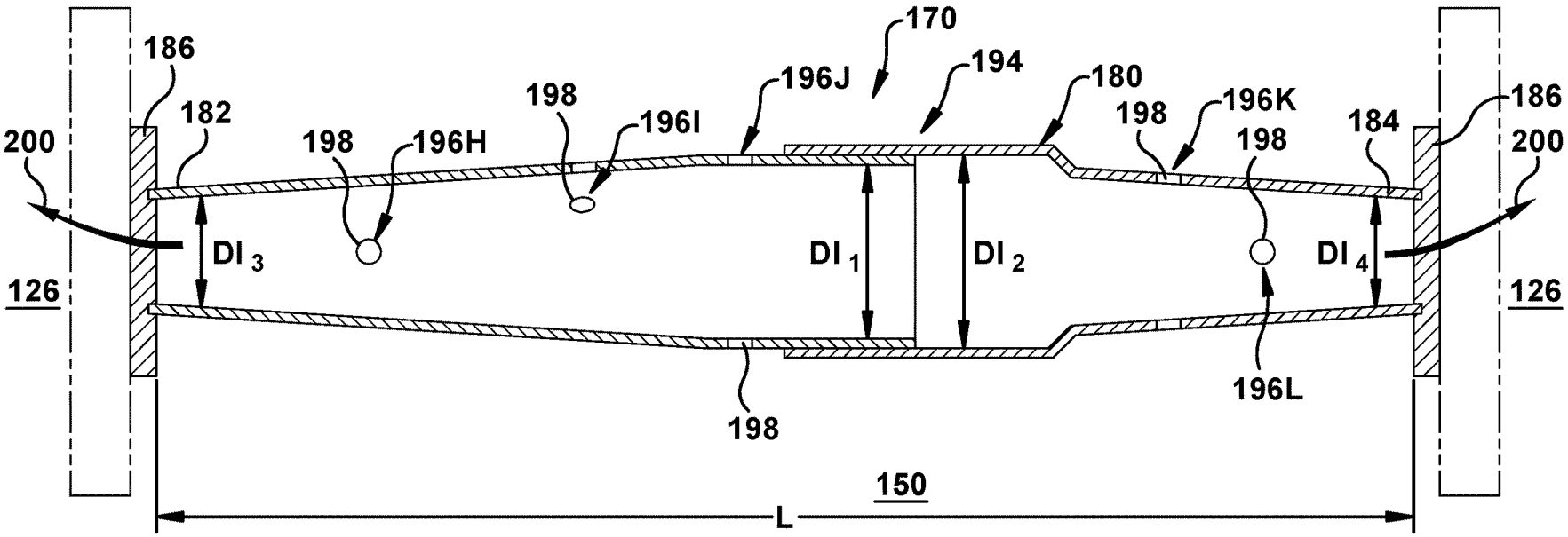
FIG. 7 shows a cross-sectional view of a cross-fire tube, according to yet other embodiments of the disclosure.

FIG. 7 shows a cross-sectional view of cross-fire tube 170 with hollow tubular body 180 having a substantially circular cross-sectional shape with mid-section 194 of the tube having one or more diameters, e.g., $DI_1$, $DI_2$, etc. Here, hollow tubular body 180 tapers continuously from mid-section 194 in opposite directions to opposite ends 182, 184 which have diameters $DI_3$, $DI_4$ smaller than all of one or more diameters $DI_1$, $DI_2$, etc. in mid-section 194. When purge air 200 flows through plurality of purge air hole pairs 196H-L (5 pairs shown), the purge air 200 is accelerated as it flows toward opposite ends 182, 184. Otherwise, cross-fire tube 170 may include any of the arrangements described herein.

For example, plurality of purge air hole pairs 196H-L may be unevenly spaced along length L of hollow tubular body 180, as in FIGS. 4-5. Plurality of purge air hole pairs 196H-L may be asymmetrically spaced relative to mid-section 194 along length L of hollow tubular body 180, as in FIGS. 4-5. Hollow tubular body 180 may include two sections 190, 192 in the form of male section 190 and female section 192 with male section 190 telescopingly received within female section 192 at mid-section 194. As in FIG. 4, some (two) of the plurality of purge air hole pairs 196H-L may be provided in female section 192, and some of the plurality of purge air hole pairs 196H-L may be provided in male section 190 (three pairs in FIG. 7 versus two pairs in FIG. 4). Each of the plurality of purge air hole pairs 196H-L may be circumferentially offset from one another, as in FIGS. 5 and 6. In the FIG. 7 example, five purge air hole pairs 196H-L are used, but any number greater than two is possible.

Cross-fire tube 170 may be made of any now known or later developed material capable of withstanding the environment within combustion section 106, e.g., a high temperature metal or metal alloy, which may be coated with a thermal barrier coating or an environmental barrier coating.

Embodiments of the disclosure provide a cross-fire tube and a combustion section including the cross-fire tube that generates a uniform distribution of a purge air between adjacent combustors. The cross-fire tube can be customized and optimized using the purge air hole pairs to obstruct flow of hot combustion gas and unburned fuel, reducing the temperature of the tube. The cross-fire tube also reduces an oxidation rate and therefore increases the life expectancy of the part. In certain embodiments, the velocity purge air flow may be as much as 25% higher exiting the opposite ends of the tube compared to conventional systems. As noted, the temperatures can be reduced, for example, by 6% on the female section and 9% on the male section compared to conventional systems made of the same materials and operating under similar conditions.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application and to enable others of ordinary skill in the art to understand the disclosure for various embodiments with various modifications as are suited to the particular use contemplated.

What is claimed is:

1. A cross-fire tube for connecting adjacent combustors in a gas turbine, the cross-fire tube comprising:

a hollow tubular body having opposite ends and two sections joined at a mid-section; and a plurality of purge air hole pairs defined in the hollow tubular body and located at more than two different axial positions between the opposite ends, and wherein the plurality of purge air hole pairs is asymmetrically spaced relative to the mid-section along a length of the hollow tubular body, and wherein purge air flows through the plurality of purge air hole pairs to thereby provide, in use, uniform distribution of the purge air between the adjacent combustors.

2. The cross-fire tube of claim 1, wherein the plurality of purge air hole pairs is unevenly spaced along the length of the hollow tubular body.

3. The cross-fire tube of claim 1, wherein the two sections include a male section and a female section, the male section telescopingly received within the female section at the mid-section.

4. The cross-fire tube of claim 3, wherein two pairs of the plurality of purge air hole pairs are provided in the male section, and two pairs of the plurality of purge air hole pairs are provided in the female section.

5. The cross-fire tube of claim 1, wherein each pair of the plurality of purge air hole pairs is circumferentially offset from one another.

6. The cross-fire tube of claim 1, wherein the plurality of purge air hole pairs includes four purge air hole pairs.

7. The cross-fire tube of claim 1, wherein the hollow tubular body has a substantially circular cross-sectional shape with a mid-section of the tube having one or more diameters, and wherein the hollow tubular body tapers continuously from the mid-section in opposite directions to the opposite ends which have diameters smaller than all of the one or more diameters in the mid-section such that when the purge air flows through the plurality of purge air hole pairs, the purge air is accelerated as the purge air flows toward the opposite ends.

8. The cross-fire tube of claim 7, wherein the plurality of purge air hole pairs is unevenly spaced along the length of the hollow tubular body.

9. The cross-fire tube of claim 7, wherein the hollow tubular body includes a male section and a female section, the male section telescopingly received within the female section at the mid-section.

10. The cross-fire tube of claim 9, wherein two pairs of the plurality of purge air hole pairs are provided in the male section, and two pairs of the plurality of purge air hole pairs are provided in the female section.

11. The cross-fire tube of claim 7, wherein each pair of the plurality of purge air hole pairs is circumferentially offset from one another.

12. The cross-fire tube of claim 7, wherein the plurality of purge air hole pairs includes five purge air hole pairs.

13. A combustion section for a gas turbine, comprising:

a plurality of annularly arranged combustors; and a cross-fire tube fluidly coupling at least two adjacent combustors, the cross-fire tube including:

a hollow tubular body having opposite ends and two sections joined at a mid-section; and a plurality of purge air hole pairs defined in the hollow tubular body located at more than two different axial positions between the opposite ends, and wherein the plurality of purge air hole pairs is asymmetrically spaced relative to the mid-section along a length of the hollow tubular body, and wherein purge air flows through the plurality of purge air hole pairs to thereby provide, in use, uniform distribution of the purge air between the adjacent combustors.

14. The combustion section of claim 13, wherein the plurality of purge air hole pairs is unevenly spaced along the length of the hollow tubular body.

15. The combustion section of claim 13, wherein each pair of the plurality of purge air hole pairs is circumferentially offset from one another.

16. The combustion section of claim 13, wherein the plurality of purge air hole pairs includes four purge air hole pairs.

17. A cross-fire tube for connecting adjacent combustors in a gas turbine, the cross-fire tube comprising:

a hollow tubular body having opposite ends and a substantially circular cross-sectional shape with a mid-section of the hollow tubular body having one or more diameters; and a plurality of purge air hole pairs defined in the hollow tubular body and located at more than two different axial positions between the opposite ends; and wherein the plurality of purge air hole pairs is asymmetrically spaced relative to the mid-section along a length of the hollow tubular body, wherein the hollow tubular body tapers continuously from the mid-section in opposite directions to the opposite ends which have diameters smaller than all of the one or more diameters in the mid-section such that when the purge air flows through the plurality of purge air hole pairs, the purge air is accelerated as the purge air flows toward the opposite ends; and wherein purge air flows through the plurality of purge air hole pairs to thereby provide, in use, uniform distribution of the purge air between the adjacent combustors.

* * * * *